US008094427B2

(12) United States Patent
Critchley et al.

(10) Patent No.: US 8,094,427 B2
(45) Date of Patent: Jan. 10, 2012

(54) SYSTEM FOR PRECISELY CONTROLLING THE OPERATIONAL CHARACTERISTICS OF A RELAY

(75) Inventors: Malcolm J. Critchley, Scottsdale, AZ (US); Yen-Kuei Tsao, La Verne, CA (US)

(73) Assignee: Leach International Corporation, Buena Park, CA (US)

( * ) Notice: Subject to any disclaimer, the term of this patent is extended or adjusted under 35 U.S.C. 154(b) by 382 days.

(21) Appl. No.: 12/354,704

(22) Filed: Jan. 15, 2009

(65) Prior Publication Data

US 2010/0177453 A1 Jul. 15, 2010

(51) Int. Cl.
*H01H 47/00* (2006.01)

(52) U.S. Cl. ..... 361/140

(58) Field of Classification Search ..... 361/140
See application file for complete search history.

(56) References Cited

U.S. PATENT DOCUMENTS

| | | | | |
|---|---|---|---|---|
| 4,318,154 | A | 3/1982 | DePuy | |
| 5,317,475 | A | 5/1994 | Siepmann | |
| 2003/0218847 | A1 | 11/2003 | Lesesky et al. | |
| 2005/0135040 | A1 | 6/2005 | Suzuki et al. | |
| 2006/0139839 | A1 | 6/2006 | Sato et al. | |
| 2010/0177453 | A1 * | 7/2010 | Critchley et al. | 361/140 |

OTHER PUBLICATIONS

Application Notes "Relays and Temperature Variations", dated Jun. 2000; 2 pages.

Linear Technology "Positive Adjustable Regulator", LT117A/LT317A; LM117/LM317; 8 pages.

National Semiconductor Corporation "3-Terminal Regulator is Adjustable"; AN-181; dated Oct. 1975; 6 pages.

International Search Report for Application No. PCT/US2010/020947 filed Jan. 13, 2010, dated Mar. 2, 2010, mailed Mar. 22, 2010, 2 pages.

Written Opinion for Application No. PCT/US2010/020947 filed Jan. 13, 2010, dated Mar. 2, 2010, mailed Mar. 22, 2010, 4 pages.

* cited by examiner

*Primary Examiner* — Ronald W Leja

(74) *Attorney, Agent, or Firm* — Christie, Parker & Hale, LLP

(57) ABSTRACT

A system for precisely controlling the operational characteristics of a relay is provided. In one embodiment, the invention relates to a relay having performance characteristics that vary with a temperature of the relay, where the relay comprises a plurality of operational phases including a switching phase and a holding phase, and a relay control circuit configured to provide a preselected current to the relay at least during the switching phase and the holding phase, where the preselected current remains substantially constant despite a change in the temperature of the relay, where the relay is configured to transition from a non-energized position to an energized position during the switching phase, and where the relay is configured to maintain the energized position during the holding phase.

19 Claims, 9 Drawing Sheets

Uncompensated Relay Parameter Dependence

| Temperature | Resistance | Current | Operating Voltage | Release Voltage | Operate Time | Release Time |
|---|---|---|---|---|---|---|
| Increase | UP | DOWN | UP | UP | UP | UP |
| Decrease | DOWN | UP | DOWN | DOWN | DOWN | DOWN |
| 10C | ~4% | ~4% | ~4% | ~4% | ~0.4% | ~0.4% |
| +25C to +85C | ~20% | ~20% | ~20% | ~20% | ~20% | ~20% |
| +25C to -55C | ~30% | ~30% | ~30% | ~30% | ~30% | ~30% |

FIG. 9

Transit time from open to closed occurs at ~70% of coil current rise and moves for 7% of coil current rise to close before current rise is finished.

Parameter dependence compensated Relay

| Temperature | Resistance | Current | Operating Voltage | Release Voltage | Operate Time | Release Time |
|---|---|---|---|---|---|---|
| Increase | UP | DOWN | UP | UP | UP | UP |
| Decrease | DOWN | UP | DOWN | DOWN | DOWN | DOWN |
| 10C | ~0% | ~0% | ~4% | ~4% | ~0.4% | ~0.4% |
| +25C to +85C | ~1% | ~1% | ~1% | ~1% | ~1% | ~1% |
| +25C to -55C | ~1% | ~1% | ~1% | ~1% | ~1% | ~1% |

FIG. 10

Armature Transit time from open to closed occurs at ~70% of coil current rise and moves for 7% of coil current rise to close before current rise is finished.

SYSTEM FOR PRECISELY CONTROLLING THE OPERATIONAL CHARACTERISTICS OF A RELAY

BACKGROUND TO THE INVENTION

The present invention relates generally to a system for precisely controlling the operational characteristics of a relay. More specifically, the present invention relates to a system for providing constant current to a relay despite variations in supply voltage and temperature.

Relays are generally operated under conditions that do not require precision timing. In some applications, however, precise control of the operational characteristics of a relay may be necessary. Important operational characteristics of a relay include the operate voltage, the release voltage, the operate time, and the release time. For a relay having normally open contacts, the operate voltage is the minimum relay coil voltage required to effect closure of the relay contacts following application of such operate voltage. The release voltage is the maximum relay coil voltage causing the relay contacts to remain closed before the contacts open when such voltage is decreased or removed. The operate time is the time elapsed from an application of the relay coil voltage until the contacts close. The release time is the time elapsed from removal of the relay coil voltage until the contacts open.

Operation of an electromagnetic relay is governed by physical properties such as the mass of moving parts, the frictional forces between components, the mechanical advantages of the design and the magnetic forces generated by a relay motor or solenoid which move a moveable mass to close the contacts. The mass of the moving parts, the component frictional forces and the mechanical advantages required to provide the requisite contact forces are generally unchanged by temperature. The magnetic forces generated by the relay motor or solenoid are directly proportional to the number of coil winding turns and the current flowing through those turns. The number of coil turns is fixed but the resistance of the coil winding material, and thus the coil current, varies with temperature according to the temperature coefficient of resistance of the winding material.

The operational characteristics of a relay are highly dependent on the coil current, which varies in accordance with coil resistance. Therefore, variations in temperature can cause substantial changes in the operational characteristics of relays and also present significant challenges in their design.

SUMMARY OF THE INVENTION

Aspects of the invention relate to a system for precisely controlling the operational characteristics of a relay. In one embodiment, the invention relates to a relay having performance characteristics that vary with a temperature of the relay, where the relay comprises a plurality of operational phases including a switching phase and a holding phase, and a relay control circuit configured to provide a preselected current to the relay at least during the switching phase and the holding phase, where the preselected current remains substantially constant despite a change in the temperature of the relay, where the relay is configured to transition from a non-energized position to an energized position during the switching phase, and where the relay is configured to maintain the energized position during the holding phase.

In another embodiment, the invention relates to a precisely controlled relay circuit including a relay having performance characteristics that vary with a temperature of the relay, where the relay comprises a plurality of operational phases including a switching phase and a holding phase, a relay control circuit configured to provide a preselected current to the relay at least during the switching phase and the holding phase, and a voltage source configured to provide a voltage to the relay control circuit, the voltage ranging from a minimum voltage to a maximum voltage, where the preselected current remains substantially constant despite a change in the voltage provided to the relay control circuit, where the relay is configured to transition from a non-energized position to an energized position during the switching phase, and where the relay is configured to maintain the energized position during the holding phase.

BRIEF DESCRIPTION OF THE DRAWINGS

FIG. 9 is a table illustrating the effects of temperature variations on the operational characteristics of a conventional uncompensated relay.

FIG. 10 is a table illustrating the effects of temperature variations on the operational characteristics of a relay controlled by a relay control circuit in accordance with an embodiment of the present invention.

DETAILED DESCRIPTION OF THE INVENTION

Figure 1:
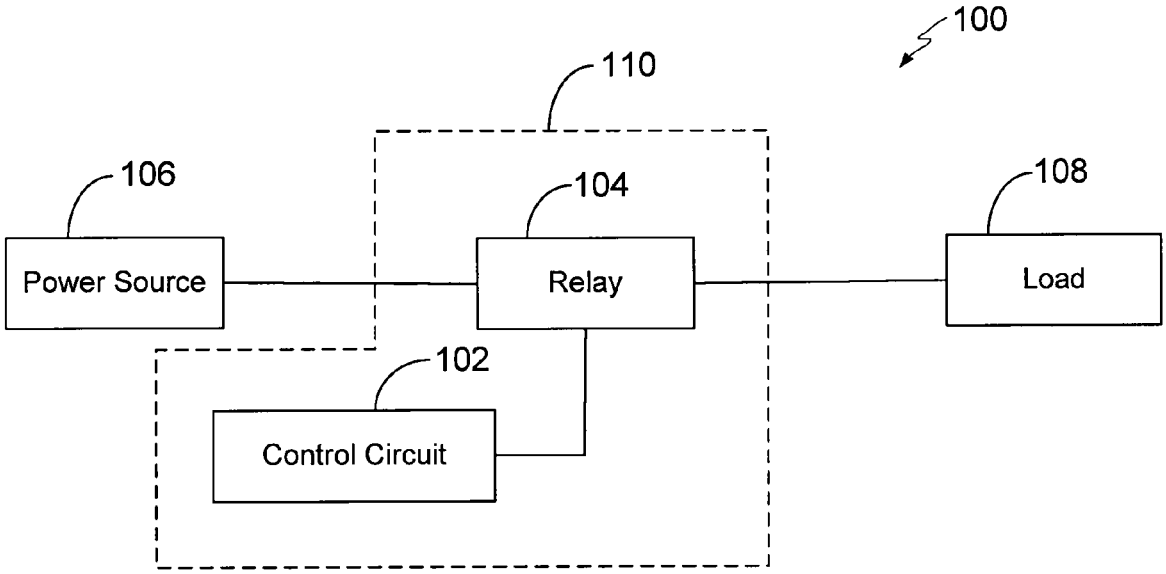
FIG. 1 is a schematic block diagram of a power control system including a relay controlled by a relay control circuit in accordance with an embodiment of the present invention.

Variations in the ambient temperature and supply voltage can result in substantial changes in the operating parameters of a relay, especially the coil current. The standard material for winding a relay coil is copper magnet wire. For a temperature range of −55° C. to 85° C., corresponding to a temperature change of 130° C., the change in resistance caused by temperature can be as much as 60%. A typical 28 volt direct current (VDC) relay can have an operating voltage range that varies from 18 volts DC to 32 volts DC (or up to 40 VDC short term). This results in a maximum voltage range of up to 22 VDC (40 VDC minus 18 VDC) or a total change of approximately 50%. The combination of temperature and voltage variations, considered cumulatively, therefore often change the operating conditions or characteristics by more than 100%. Thus, typical relay circuits generally must accommodate wide varying operating conditions that often force undesirable compromises in their design.

To illustrate such variations in temperature and the resulting changes in the coil current, the operation of a typical 28 volt relay requiring approximately 2 watts of power to change the position of its contacts is analyzed. Table 1 illustrates the operational characteristics of a conventional 28 volt relay driven at approximately 32 volts over a range of temperatures.

TABLE 1

| | Coil Temp. | | |
|---|---|---|---|
| | −40° C. | 25° C. | +85° C. |
| Voltage Rating (coil) | 28 | 28 | 28 |
| Watt Rating (coil) | 2 | 2 | 2 |
| Coil Resistance at 25° C. | 290 | 290 | 290 |
| Tolerance (−5%) | 275 | 275 | 275 |
| Actual Resistance | 275 | 275 | 275 |
| Nominal Temp. | 25 | 25 | 25 |
| Working Temp. | −40 | 0 | 85 |
| Temp. Range | −65 | 0 | 60 |
| Resistance at Temp. | 191 | 275 | 353 |
| Diode drop | 0.7 | 0.7 | 0.7 |
| Coil Voltage | 32.2 | 32.2 | 32.2 |
| Actual Voltage | 31.5 | 31.5 | 31.5 |
| Coil Current (A) | 0.165 | 0.114 | 0.089 |

In Table 1, the characteristics of the relay are shown at three temperature points including −40° C., 25° C., and 85° C. Also, in Table 1, the actual voltage applied to the coil is approximately 32 volts. The last row illustrates the coil current at the three temperature points. Table 2 illustrates the operational characteristics of the conventional 28 volt relay driven at approximately 18 volts over a range of temperatures.

TABLE 2

| | Coil Temperature | | |
|---|---|---|---|
| | −40° C. | 25° C. | +85° C. |
| Voltage Rating (coil) | 28 | 28 | 28 |
| Watt Rating (coil) | 2 | 2 | 2 |
| Coil Resistance at 25° C. | 290 | 290 | 290 |
| Tolerance (+5%) | 304 | 304 | 304 |
| Actual Resistance | 304 | 304 | 304 |
| Nominal Temp. | 25 | 25 | 25 |
| Working Temp. | −40 | 0 | 85 |
| Temp. Range | −65 | 0 | 60 |
| Resistance at Temp. | 211 | 304 | 390 |
| Diode drop | 0.7 | 0.7 | 0.7 |
| Coil Voltage | 18 | 18 | 18 |
| Actual Voltage | 17.3 | 17.3 | 17.3 |
| Coil Current (A) | 0.082 | 0.057 | 0.044 |

In Table 2, the actual voltage applied to the coil is approximately 17 volts. The relay characteristics at the same temperature points of −40° C., 25° C., and 85° C. as in Table 1 are also depicted. Also, in Table 2, the smallest coil current is found at 85° C. and is 0.044 amps (A). In Table 1, the largest coil current is found at −40° C. and is 0.165 A. The ratio of the largest coil current to the smallest coil current is 3.75. Thus, the empirical data depicted in Table 1 and Table 2 illustrates a maximum current variation of 375% over a voltage range of 18 to 32 volts and temperature range of −40° C. to 85° C.

Turning now to the drawings, embodiments of relay control circuits precisely control the current provided to a relay despite changes in voltage and temperature. In many embodiments, the relay control circuits provide a constant current despite changes in voltage and temperature. In several embodiments, the relay control circuits include an adjustable linear voltage regulator and control resistor to provide the constant current. In other embodiments, other circuit components can be used to provide the constant current.

In one embodiment, the relay control circuits and controlled relays are used to control the distribution of power in an aircraft electrical system. Power can be distributed using various DC or AC (single, two or three phase) systems, or combinations thereof. In a number of embodiments, the relay has one load switch that switches a DC power source. In several embodiments, the DC power sources operate at 28 volts, 26 volts or 270 volts. In one embodiment, DC power sources operate in the range of 11 to 28 volts. In other embodiments, the relays include three load switches that switch AC power sources. In one embodiment, the AC power source operates at 115 volts and at a frequency of 400 hertz. In other embodiments, the relays controlled by the relay control circuits have a single load switch that can switch a DC power source or a single phase of an AC power source. In other embodiments, the power sources operate at other voltages and other frequencies. In one embodiment, the DC power sources can include batteries, auxiliary power units and/or external DC power sources. In one embodiment, the AC power sources can include generators, ram air turbines and/or external AC power sources.

FIG. 1 is a schematic block diagram of a power control system 100 including a relay 104 controlled by a relay control circuit 102 in accordance with an embodiment of the present invention. The relay control circuit 102 and relay 104 can effectively form a precisely controlled relay circuit 110 that resists and counteracts changes in variable factors affecting the relay operation, such as changes in supply voltage or ambient temperature. The relay 104 is coupled to the relay control circuit 102, a power source 106, and a load 108. In operation, the relay 104 controls the flow of current between the power source 106 and the load 108 based on control signals received from the relay control circuit 102. In one embodiment, the power source 106 is a source commonly used in an aircraft. In such case, the load is an aircraft load such as, for example, aircraft lighting and/or aircraft heating and cooling systems.

Figure 2:
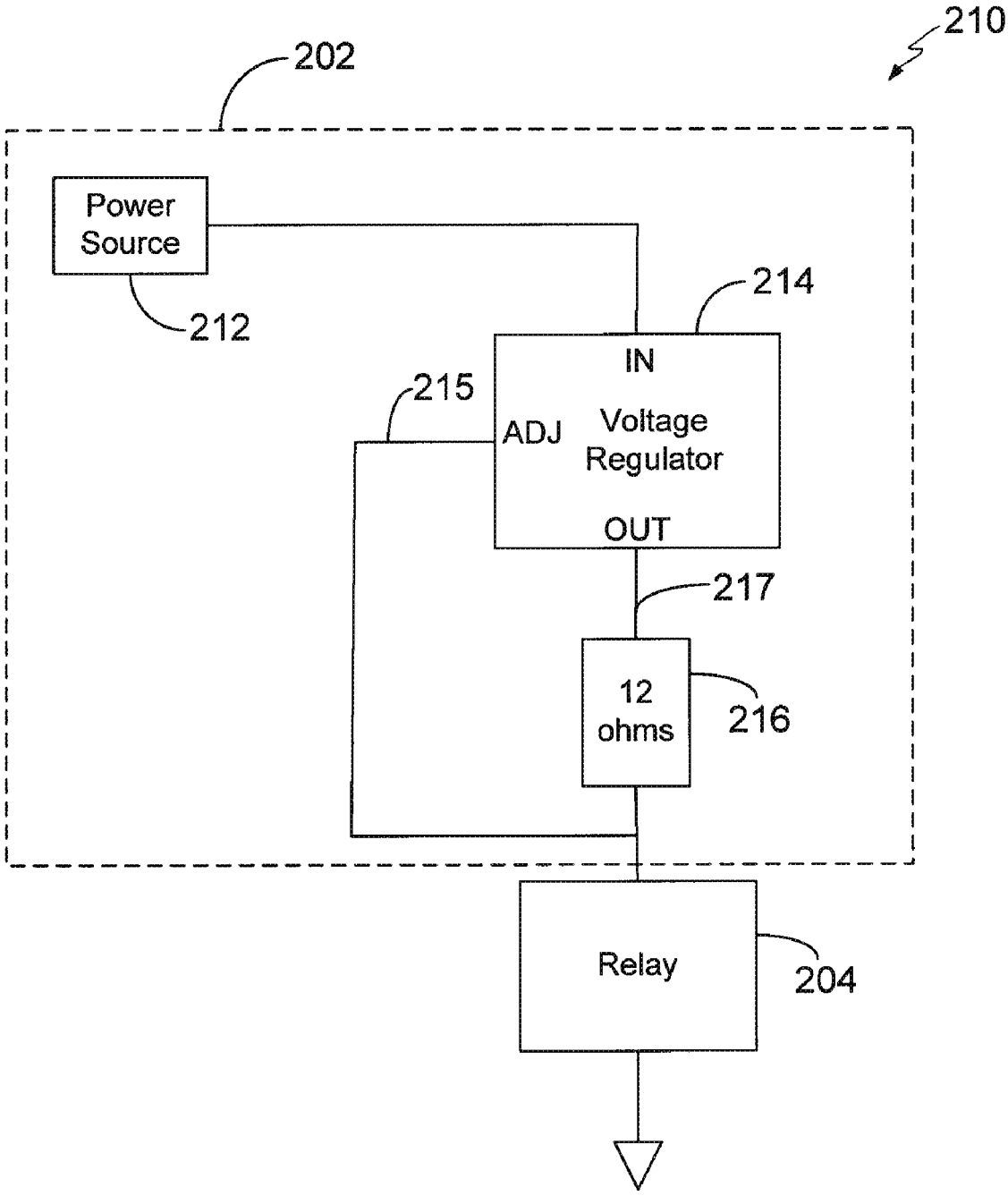
FIG. 2 is a schematic block diagram of a relay control circuit coupled with a relay in accordance with an embodiment of the present invention.

FIG. 2 is a schematic block diagram of a relay control circuit 202 and a relay 204 in accordance with an embodiment of the present invention. The relay control circuit 202 is coupled to the relay 204 and effectively forms a precisely controlled relay circuit 210. The relay control circuit 202 includes an adjustable linear voltage regulator 214 having an adjustment input 215 and an output terminal 217 coupled to a control resistor 216. The adjustable regulator 214 is coupled to a power source 212. The control resistor 216 is coupled to the relay 204 at a node. The node coupling the relay 204 and the resistor 216 is also coupled to the adjustment input 215 of the adjustable voltage regulator 214.

In operation, the adjustable linear voltage regulator 214 maintains a relatively constant voltage across the output terminal 217 and adjustment input 215. By placing a control resistor 216 across the output terminal 217 and adjustment input terminal 215, the adjustable voltage regulator acts to provide a constant current, and therefore constant voltage drop, through the control resistor 216. In such case, where the resistance of the relay 204 varies in accordance with changes in temperature or applied voltage, the adjustable voltage regulator acts to compensate for those changes such that constant current is provided despite the variation.

In one embodiment, the adjustable voltage regulator is a LM117 positive adjustable voltage regulator made by Linear Technology Corporation of Milpitas, Calif. In such case, the regulator attempts to maintain a constant reference voltage of 1.25 volts across the output terminal and adjustable input terminal. In this case, a constant current of approximately 0.1 A is provided to the relay 204, when the voltage regulator 214 is turned on. When the resistance of the windings in the relay coil 204 changes in response to a change in temperature, the adjustable voltage regulator adjusts the voltage provided at its output terminal 217 to maintain the constant current of approximately 0.1 A. For example, when the temperature increases, the resistance of the relay coil 204 also increases. In such case, the voltage regulator 214 must increase the voltage at output terminal 217 in order to maintain the constant current and the reference voltage across the control resistor 216.

The use of an adjustable linear voltage regulator provides benefits not only in maintaining a constant current in the relay coil, but also in withstanding swings in the switching voltage supplied to the relay. For example, the voltage regulator is generally able to accept a wide range of swings in input voltage provided that such input voltage is greater than that of the regulator output voltage by at least a drop-out voltage. The drop-out voltage is generally a characteristic of the regulator.

In the illustrated embodiment, the control resistor is 12 ohms. In other embodiments, the control resistor can take other values. In a number of embodiments, the control resistor has a very low tolerance to minimize variation in current flowing through the resistor.

In other embodiments, other circuits capable of providing a constant current can be used to control the relay. In some embodiments, the other relay control circuits can tolerate wide voltage swings while providing the constant current.

Figure 3:
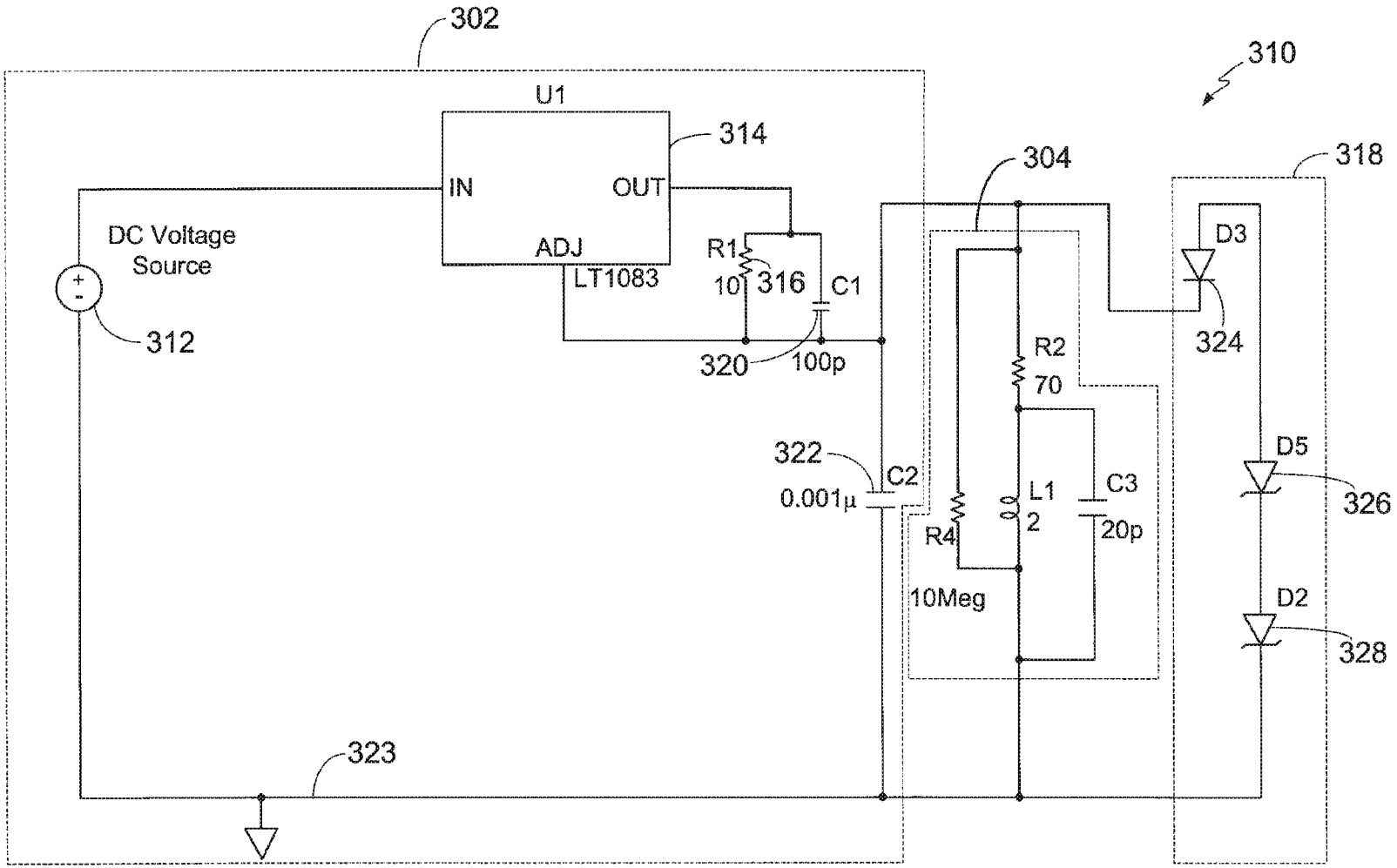
FIG. 3 is a schematic diagram of a simulated relay control circuit coupled with a relay in accordance with an embodiment of the present invention.

FIG. 3 is a schematic diagram of a simulated relay circuit 310 in accordance with an embodiment of the present invention. The simulated relay circuit 310 is used to examine the operational characteristics of a particular relay circuit and it includes a simulated relay control circuit 302 coupled with a simulated relay 304 which is coupled to a transient suppression circuit 318. The simulated relay control circuit 302 includes an AC voltage source 312 coupled to an adjustable voltage regulator 314 having an output terminal and an adjustment terminal. A resistor 316 and capacitor 320 are connected in parallel across the output terminal and adjustment terminal of the regulator 314. A second capacitor 322 couples the adjustment terminal to a ground 323. The ground 323 is also coupled to the voltage source 312.

The simulated relay 304 includes a resistor R2 coupled to the adjustment terminal of the regulator 314 and to the ground 323 via an inductor/coil L1. The inductor L1 is coupled in parallel by a third capacitor C3. The simulated relay 304 also includes a resistor R4 coupled to the adjustment terminal of the regulator 314 and the ground 323. The combination of R2, L1, C3 and R4 provides the electrical characteristics of a typical relay.

The transient suppression circuit 318 includes a diode 324 coupled in series with two zener diodes (326, 328). The cathode of zener diode 328 is coupled to ground 323. Zener diodes 326 and 328 are oriented in the same direction such that the cathode of zener 326 is coupled to the anode of zener 328. Diode 324 and zener 326 are connected in a back to back configuration such that the anode of diode 324 is coupled to the anode of zener diode 326. The cathode of diode 324 is coupled to the adjustment terminal of the regulator 314. The transient suppression circuit 318 handles reverse biased voltage spikes with the zener diodes and effectively discharges the simulated relay 304. More specifically, the transient suppression circuit 318 can discharge the energy stored in the coil L1.

In operation, the AC voltage source 312 provides a voltage signal of 32 volts after a 10 millisecond (ms) delay. The voltage signal is thus provided with a rise time of 10 ms and a fall time of 10 ms. In other embodiments, the AC voltage source can provide a voltage signal at another voltage level and with other timing characteristics.

Figure 4:
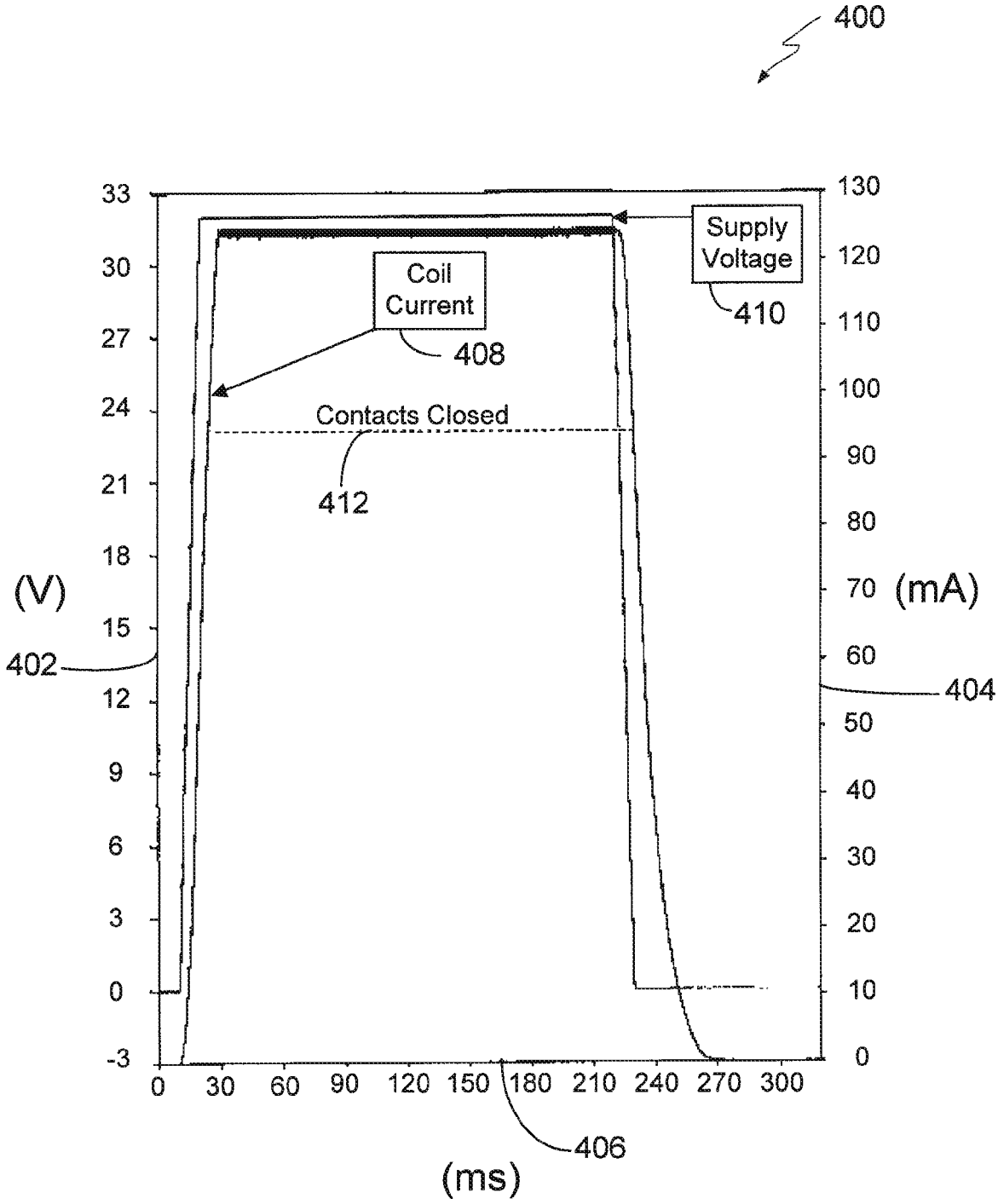
FIG. 4 is a graph of supply voltage and coil current versus time for the simulated relay control circuit of FIG. 3.

FIG. 4 is a graph of supply voltage 410 and coil current 408 versus time 406 for the simulated relay control circuit of FIG. 3. The coil current 408 results from the applied supply voltage 410. A voltage scale 402 and current scale 404 depict the magnitude of the supply voltage and coil current, respectively. A dashed horizontal line 412 indicates the magnitude of the coil current at which the relay contacts close, or otherwise change position (e.g., for a normally closed relay). The operate time is illustrated as the rise time in the supply voltage 410, or the time from when the supply voltage 410 is at 0 volts to the time when the supply voltage 410 is at the "contacts closed" line 412, at approximately 23 volts. The release time can also be observed as the fall time in supply voltage 410, where the fall time is the time beginning from the removal of the supply voltage 410 to the point at which the contacts are opened (e.g., just below the horizontal contacts closed line on the falling portion of the supply voltage 410).

In simulation testing of the embodiment described in FIG. 3, the operate time was unchanged despite variations in the voltage supply along a range from 18 to 40 VDC. Similarly, the release time was unchanged despite the variation in voltage supply ranging from 18 to 40 VDC. In further simulation testing of the embodiment described in FIG. 3, the operate time remained unchanged despite variations in the temperature of the relay coil. Similarly, the release time remained unchanged despite variations in the temperature of the relay coil. Effectively, the simulation testing shows that the operational characteristics of the precisely controlled simulated relay are substantially unchanged despite variations in either temperature or voltage applied to the relay.

In a number of embodiments, the performance characteristics of a relay can be classified into multiple operational phases. In some embodiments, for example, a switching phase can be defined as the phase where the relay transitions from a non-energized state to an energized state. In one embodiment, the switching phase is a time period that corresponds to the operate time. In another embodiment, in a holding phase of the relay can be defined as the phase where the relay maintains the energized state. The non-energized state, as used herein, means the state of the relay when little or no voltage has been applied to the relay coil. The energized state, as used herein, means the switched state of the relay after a switching voltage, sufficient to effect a change in position of the relay contacts, has been applied to the relay.

Figure 5:
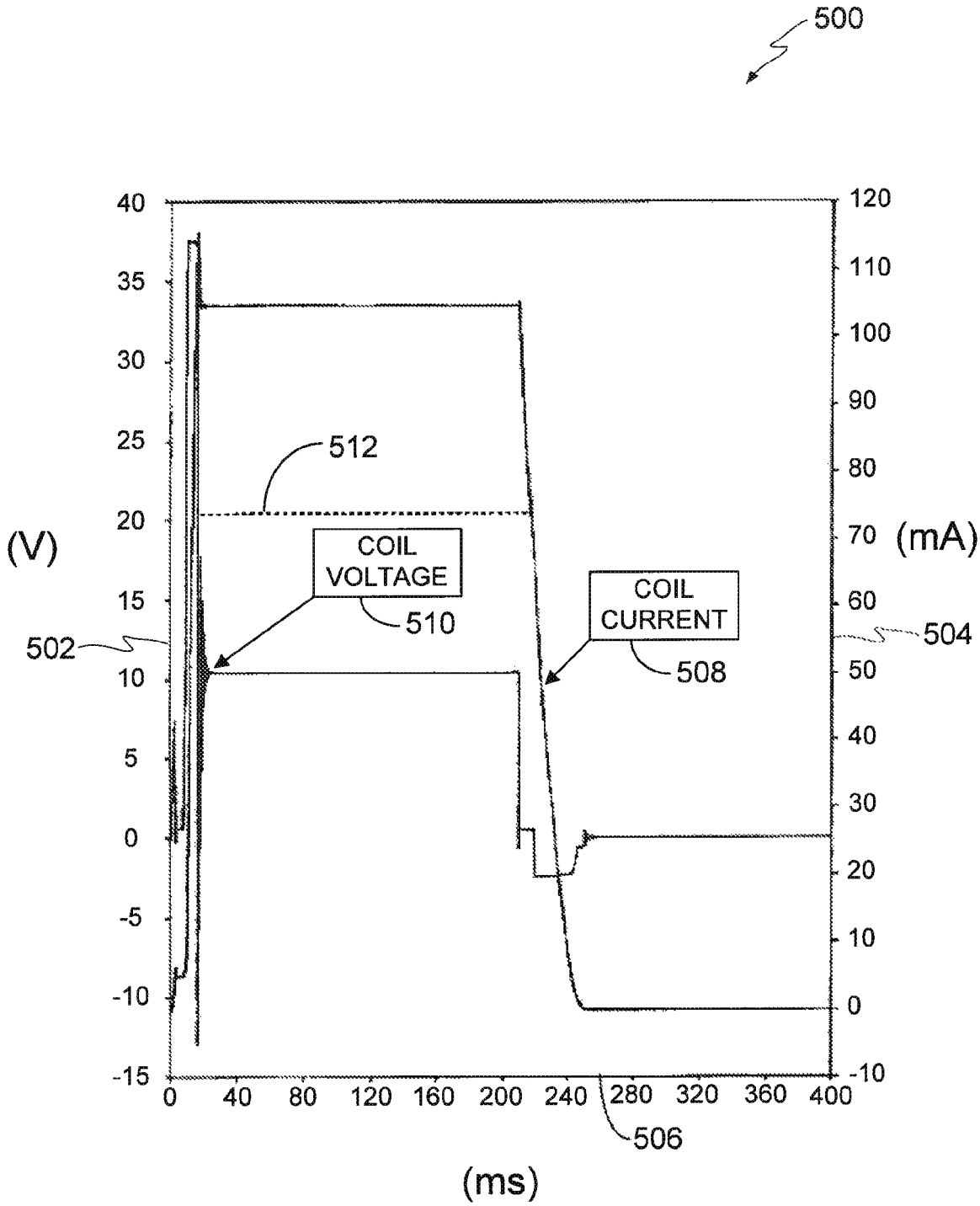
FIG. 5 is a graph of coil voltage and coil current versus time for the simulated relay control circuit of FIG. 3.

FIG. 5 is a graph of typical coil voltage 510 and coil current 508 versus time 506 for the simulated relay control circuit of FIG. 3. A voltage scale 502 and current scale 504 depict the magnitude of the coil voltage and coil current, respectively. A dashed horizontal line 512 indicates the magnitude of the coil current 508 at which the relay contacts closed, or were otherwise switched.

Figure 6:
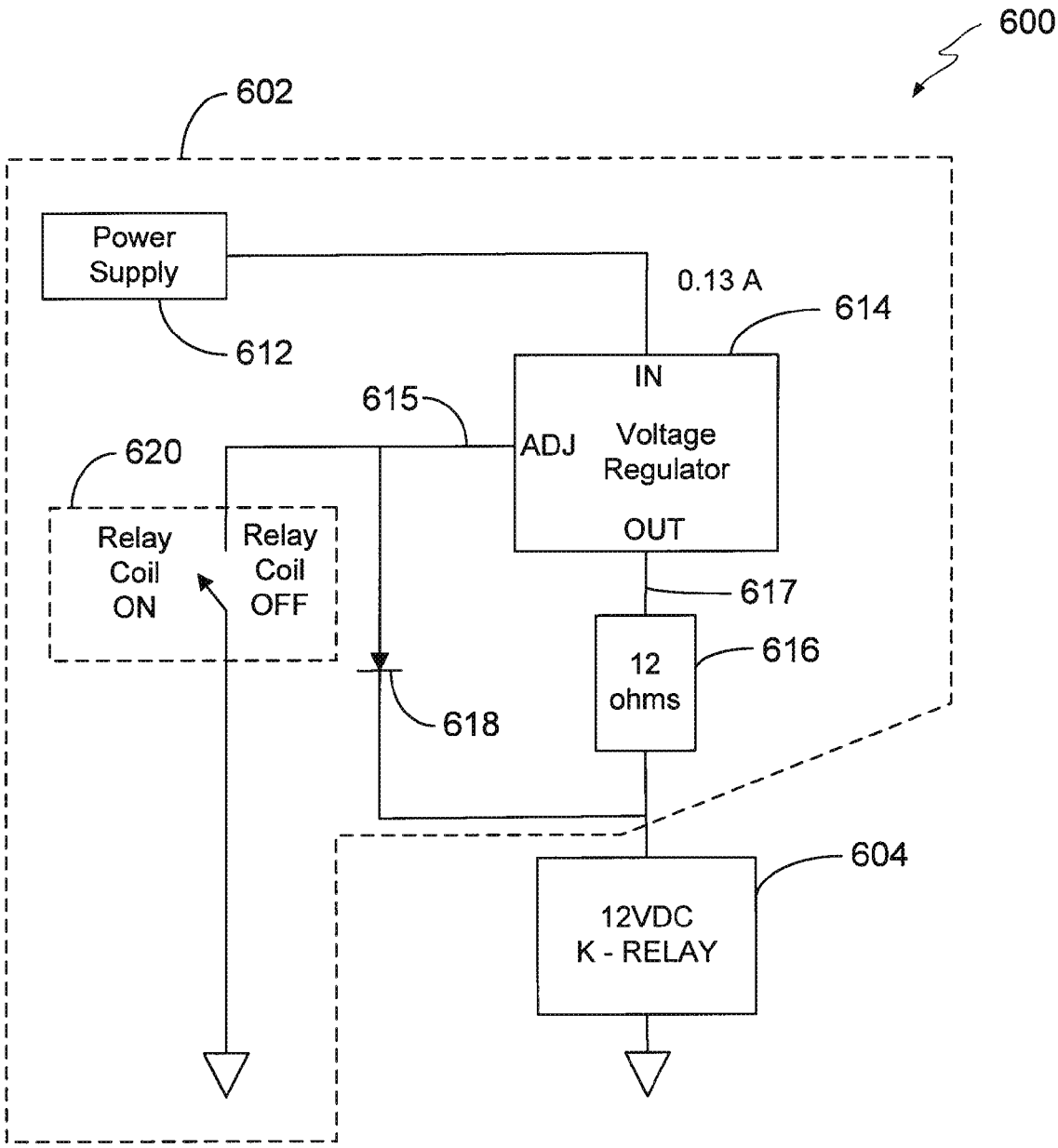
FIG. 6 is a schematic diagram of a relay control circuit, coupled to a relay, having an external control circuit in accordance with an embodiment of the present invention.

FIG. 6 is a schematic diagram of a relay control circuit 602 having an external control circuit 620 in accordance with an embodiment of the present invention. The relay control circuit 602 includes an adjustable linear voltage regulator 614 having an adjustment input 615 and an output terminal 617 coupled to a control resistor 616. The adjustable regulator can maintain a constant voltage despite variations in input voltage. The adjustable regulator 614 is also coupled to a power source 612. The control resistor 616 is coupled to the relay 604 at a node. The node coupling the relay 604 and the resistor 616 is also coupled to the adjustment input 615 of the adjustable voltage regulator 614 via a diode 618. The anode of diode 618 is coupled to the adjustment input 615 of the voltage regulator 614. The cathode of diode 618 is coupled to the relay 604.

An external control circuit 620 is coupled to the adjustment input 615 of the linear voltage regulator 614. In the embodiment illustrated in FIG. 6, the external control circuit 620 is shown as a simple single throw switch. In other embodiments, the external control circuit 620 can include other forms of controlling and processing circuitry coupled to a switching device. The external control circuitry 620 can enable remote control of the relay control circuit 602. In the embodiment illustrated in FIG. 6, the external control circuitry is configured to pull the regulator control input to ground. In such case, the regulator 614 is disabled and the relay is de-energized. In a number of embodiments, the external control circuitry 620 enables an override of the relay regardless of the current status of the voltage regulator 614. In some embodiments, the external control circuit effectively disables the relay 604.

In operation, the relay control circuit 602 can otherwise operate in the manner described for the embodiment of FIG. 2.

Figure 7:
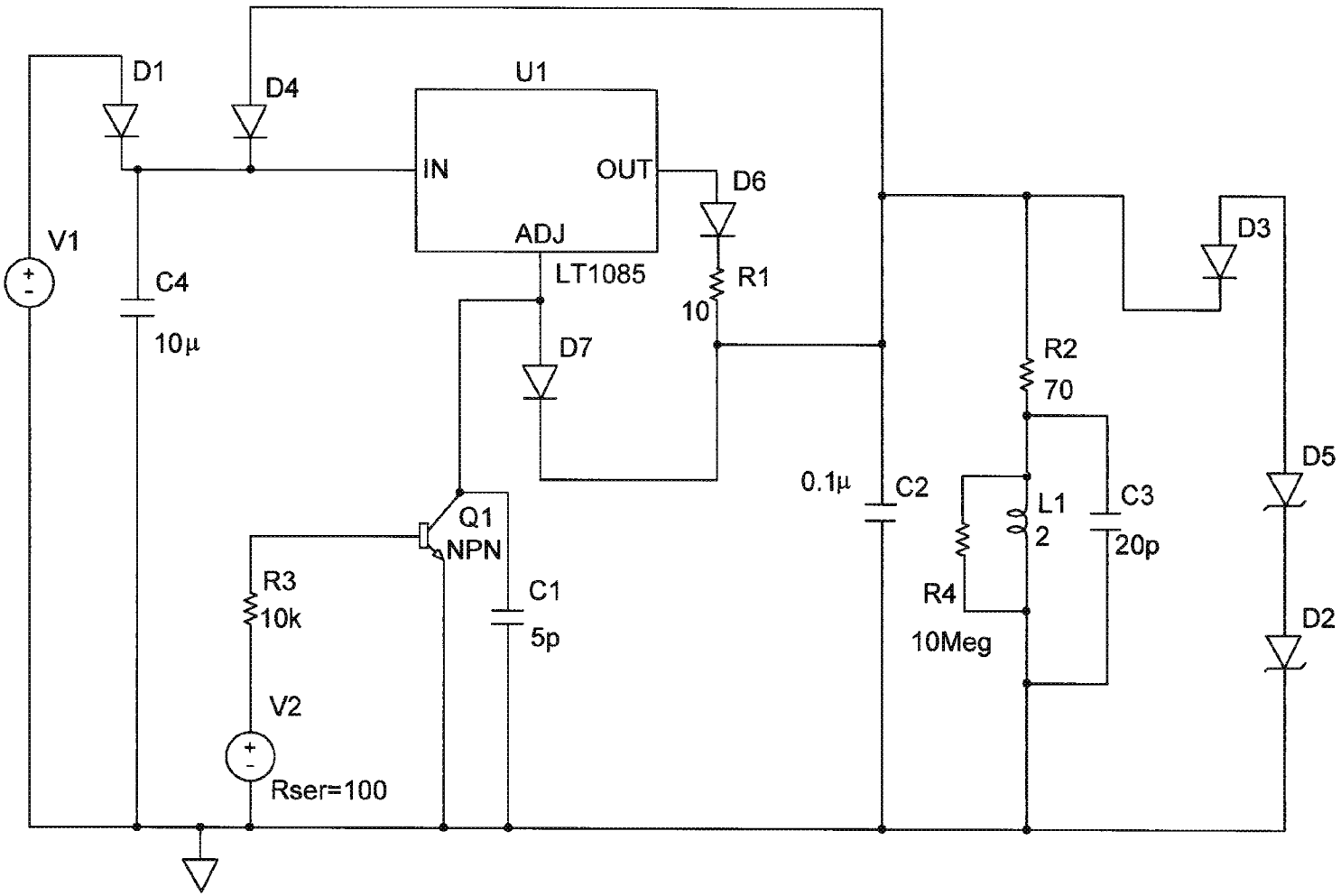
FIG. 7 is a schematic diagram of a simulated relay control circuit, coupled with a relay, having an external control in accordance with an embodiment of the present invention.

FIG. 7 is a schematic diagram of a simulated relay control circuit having an external control circuit in accordance with an embodiment of the present invention. The external control circuit includes a voltage source V2 that controls a transistor Q1 for driving the adjustment terminal of the voltage regulator U1 to ground. In other respects, the embodiment of FIG. 7 can operate like the simulated relay control circuit described for FIG. 3.

Figure 8:
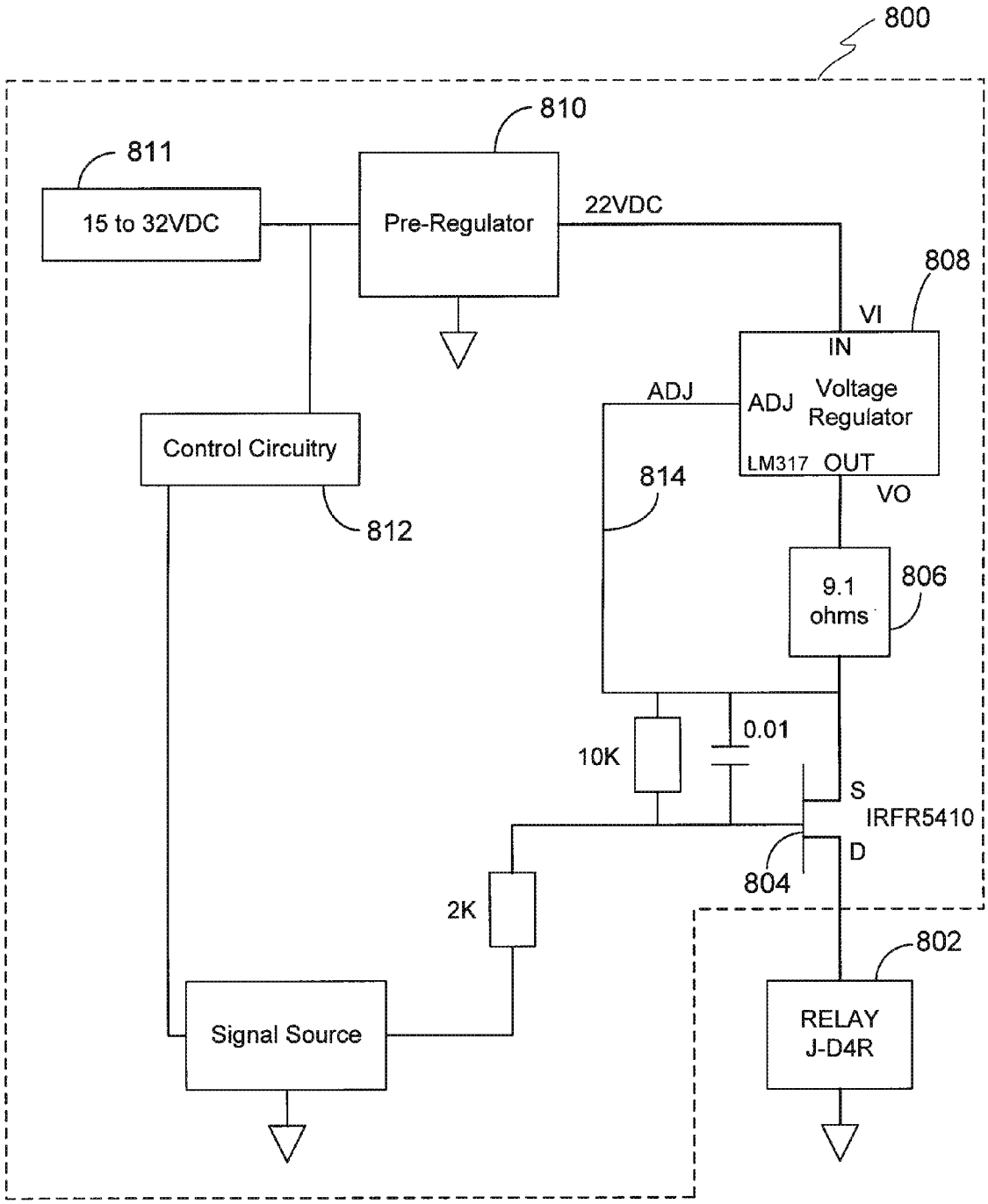
FIG. 8 is a schematic block diagram of a relay control circuit coupled with a relay in accordance with another embodiment of the present invention.

FIG. 8 is a schematic block diagram of a relay control circuit 800 coupled with a relay 802 in accordance with another embodiment of the present invention. The relay control circuit 800 includes a power MOSFET switch 804 to control the flow of current to the relay 802, a control resistor 806 to provide a constant current, a linear voltage regulator 808 to provide a constant voltage, pre-regulator circuitry 810 to condition supply voltage for the regulator 808, and control circuitry 812 for controlling the MOSFET switch 804 to connect and disconnect the constant current to the relay 800.

The drain terminal of the MOSFET switch 804 is coupled to the relay 802. The source terminal of the switch 804 is coupled to the control resistor 806 and to an adjustment input, "ADJ", of the linear voltage regulator 808. The control resistor 806 is coupled to an "OUT" terminal of the voltage regulator 808. An "IN" terminal of the voltage regulator 808 is coupled to the pre-regulator circuitry 810. The pre-regulator circuitry 810 is coupled to a voltage source 811. The voltage source 811 is also coupled to the control circuitry 812. The control circuitry 812 is coupled by signal source circuitry to the gate of MOSFET switch 804. An RC circuit couples the gate of the MOSFET switch 804 to the source. In several embodiments, the MOSFET switch 804 is P-channel power MOSFET.

In operation, the control circuitry 812 controls the MOSFET switch 804 by way of the signal source. When the signal source is driven to ground, the gate voltage of the switch 804 becomes a fraction of the voltage at the source terminal. The fraction can depend on resistor values in the illustrated voltage divider. In the embodiment illustrated in FIG. 8, the gate voltage can be one sixth the source voltage when the signal source has been driven to ground. In one embodiment, the source terminal voltage is approximately 12 volts. In such case, the gate voltage is approximately 2 volts and the $-V_{GS}$ voltage is greater than the threshold turn on voltage (e.g., approximately 4 volts). In such case, the MOSFET switch 804 is turned on and constant current is provided to the relay 802. When the signal source is driven to a supply voltage instead of ground, the gate is driven to a higher voltage and $-V_{GS}$ is no longer greater than the threshold. In such case, the MOSFET switch is turned off and little or no current is supplied to the relay. In other embodiments, the voltage regulator 808 can be controlled by switching the ADJ terminal to ground.

The pre-regulator circuitry 810 conditions the voltage provided to the voltage regulator. In some embodiments, the pre-regulator circuitry includes transient suppression circuitry that suppresses transients, such as spikes in supply voltage.

In one embodiment, the adjustable voltage regulator is a LM317 positive adjustable voltage regulator made by Linear Technology Corporation of Milpitas, Calif. In the illustrated embodiment, the control resistor has a resistance of 9.1 ohms. In other embodiments, the control resistor can have a resistance value that is greater than or less than 9.1 ohms. In one embodiment, the MOSFET switch is a IRFR5410 P-channel power MOSFET made by International Rectifier Corporation of El Segundo, Calif. In one embodiment, relay 802 controls the flow of power between a secondary power source and a primary bus on an aircraft. In such case, the relay may have to react to a sudden loss of power within a short amount of time. In this instance, the precisely controlled relay circuit, being virtually resistant to variations in temperature and voltage, can react quickly to switch auxiliary power to the aircraft primary bus. In other embodiments, the relay control circuit is used to switch power between other power sources and buses, or between other components of power systems.

FIG. 9 is a table illustrating the effects of temperature variations on the operational characteristics of a conventional or uncompensated relay. The data shown in FIG. 9 is based on a relay that is not controlled by a relay control circuit capable of supplying a constant current, and is thus effectively uncompensated. The first two rows demonstrate the general effect of temperature on particular uncompensated relay operational characteristics or parameters. For example, if temperature increases, as depicted in the second row (row two) from the top of the table, relay resistance goes up, relay current goes down, operating voltage goes up, release voltage goes up, operate time goes up and release time goes up. However, if temperature decreases, as depicted in row three, relay resistance goes down, relay current goes up, operating voltage goes down, release voltage goes down, operate time goes down and release time goes down.

As temperature ranges from +25° C. to +85° C. (row five), the relay resistance varies approximately 20 percent, the relay current varies approximately 20 percent, the operating voltage varies approximately 20 percent, the release voltage varies approximately 20 percent, the operate time varies approximately 20 percent and the release time varies approximately 20 percent. Similarly, as temperature ranges from +25° C. to −55° C. (row six), the relay resistance varies approximately 30 percent, the relay current varies approximately 30 percent, the operating voltage varies approximately 30 percent, the release voltage varies approximately 30 percent, the operate time varies approximately 30 percent and the release time varies approximately 30 percent. Accordingly, the table of FIG. 9 confirms that there is generally substantial variation in the operation of a conventional relay over temperature.

In the table shown in FIG. 9 for an uncompensated relay, the transit time from the opening of the relay contacts to the close of the relay contacts occurs at approximately 70% of the relay coil current rise, where the relay contacts move for approximately 7% of the coil current rise time before the contact are closed.

FIG. 10 is a table illustrating the effects of temperature variations on the operational characteristics of a relay controlled by a relay control circuit in accordance with an embodiment of the present invention. In contrast to the uncompensated relay of FIG. 9, the operational characteristics of the relay controlled by a constant current control circuit vary by approximately 1 percent over variations in temperature. The constant current controlled relay therefore can withstand changes in operational temperature significantly better than the conventional relay. In such case, significant advantages in performance timing are achieved. In some embodiments, the use of constant current controlled relays provides reduced power consumption resulting in less self generated heat and longer life of the relay.

While the above description contains many specific embodiments of the invention, these should not be construed as limitations on the scope of the invention, but rather as an example of one embodiment thereof. Accordingly, the scope of the invention should be determined not by the embodiments illustrated, but by the appended claims and their equivalents.

What is claimed is:

1. A precisely controlled relay circuit comprising:

a relay having performance characteristics that vary with a temperature of the relay, wherein the relay comprises a plurality of operational phases including a switching phase and a holding phase; and a relay control circuit configured to provide a preselected current to the relay at least during the switching phase and the holding phase, wherein the preselected current remains substantially constant despite a change in the temperature of the relay, wherein the relay is configured to transition from a non-energized position to an energized position during the switching phase, and wherein the relay is configured to maintain the energized position during the holding phase.

2. The circuit of claim 1, further comprising:

a voltage source configured to provide a voltage to the relay control circuit, the voltage ranging from a minimum voltage to a maximum voltage;

wherein the preselected current remains substantially constant despite a change in the voltage provided to the relay control circuit.

3. The circuit of claim 1, wherein the relay control circuit comprises a linear voltage regulator.

4. The circuit of claim 3, further comprising a resistor coupled to an output of the linear voltage regulator and to the relay.

5. The circuit of claim 4, wherein the linear voltage regulator comprises:

an input coupled to a voltage source; and an adjustment input coupled to the relay.

6. The circuit of claim 5, wherein the adjustment input is coupled to the relay using a diode, wherein the cathode of the diode is coupled to the relay.

7. The circuit of claim 1, wherein the relay control circuit comprises an override circuit configured to control a flow of current to the relay.

8. The circuit of claim 7, wherein the override circuit is controlled by external circuitry.

9. The circuit of claim 1, wherein the relay control circuit comprises:

a linear voltage regulator;

a resistor coupled to the linear voltage regulator; and a MOSFET switch coupled to the resistor and the relay;

wherein the MOSFET switch is controlled by external circuitry.

10. The circuit of claim 9, wherein the linear voltage regulator comprises:

an input coupled to a voltage source;

an output coupled to the resistor; and an adjustment input coupled to the MOSFET switch.

11. The circuit of claim 1, wherein operational characteristics of the precisely controlled relay circuit remain substantially unchanged despite the change in the temperature of the relay.

12. The circuit of claim 11, wherein the operational characteristics include an operate voltage, a release voltage, an operate time, and a release time.

13. The circuit of claim 11, wherein the temperature varies within a range of 25 degrees Celcius to 85 degrees Celcius.

14. The circuit of claim 13, wherein the constant current varies by less than 2 percent despite the change in the temperature of the relay.

15. The circuit of claim 13, wherein the operational characteristics of the precisely controlled relay circuit vary by less than 2 percent despite the change in the temperature of the relay.

16. The circuit of claim 11, wherein the temperature varies within a range of 25 degrees Celcius to −55 degrees Celcius.

17. The circuit of claim 16, wherein the constant current varies by less than 2 percent despite the change in the temperature of the relay.

18. The circuit of claim 16, wherein the operational characteristics of the precisely controlled relay circuit vary by less than 2 percent despite the change in the temperature of the relay.

19. A precisely controlled relay circuit comprising:

a relay having performance characteristics that vary with a temperature of the relay, wherein the relay comprises a plurality of operational phases including a switching phase and a holding phase;

a relay control circuit configured to provide a preselected current to the relay at least during the switching phase and the holding phase; and a voltage source configured to provide a voltage to the relay control circuit, the voltage ranging from a minimum voltage to a maximum voltage, wherein the preselected current remains substantially constant despite a change in the voltage provided to the relay control circuit, wherein the relay is configured to transition from a non-energized position to an energized position during the switching phase, and wherein the relay is configured to maintain the energized position during the holding phase.

* * * * *